US005972552A

United States Patent [19]

Ganapathiappan et al.

[11] Patent Number: 5,972,552

[45] **Date of Patent: *Oct. 26, 1999**

[54] PHOTOCONDUCTOR COMPRISING A COMPLEX BETWEEN METAL OXIDE PHTHALOCYANINE COMPOUNDS AND HYDROXY OR AMINE COMPOUNDS

[75] Inventors: Sivapackia Ganapathiappan, Mountain View; Khe C. Nguyen, Los Altos, both of Calif.

[73] Assignee: Hewlett-Packard Company, Palo Alto, Calif.

[ * ] Notice: This patent is subject to a terminal disclaimer.

[21] Appl. No.: 09/025,142

[22] Filed: Feb. 18, 1998

Related U.S. Application Data

[63] Continuation-in-part of application No. 08/634,495, Apr. 18, 1996, Pat. No. 5,750,300.

[51] Int. Cl.[6] ..... G03G 5/087

[52] U.S. Cl. ..... 430/96; 430/133

[58] Field of Search ..... 430/78, 96, 134, 430/56, 133

[56] References Cited

U.S. PATENT DOCUMENTS 5,536,611 7/1996 Arudi et al. ..... 430/96

5,750,300 5/1998 Nguyen ..... 430/78

*Primary Examiner*—John Goodrow

[57] ABSTRACT

Embodiments of photoconductors and methods of making photoconductors for electrophotography are described, each embodiment comprising a complex between metal oxide phthalocyanine compound(s) and hydroxy compound(s) or amine compound(s). A metal oxide phthalocyanine pigment exhibits extended photoresponse between 850 nm and 1000 nm when it is milled with hydroxy binders or amine binders. The preferred hydroxy or amine binders include a modified poly-vinyl butyral binder unit containing a —$CH_2CH_2OH$ unit, a cyclohexanol unit, a —$CH_2CH_2NH_2$ unit, a —$CH_2C_6H_{10}$—$NH_2$ unit, a —$CH_2C_6H_{10}$—$CH_2NH_2$ unit, a —$CH_2C_6H_4$—$NH_2$ unit, or other hydroxy or amine units. Optionally, hydroxy solvents or other hydroxy additives may also be included. Preferably, the pigment is dehydrated or hydroxy-starved before milling with the binder and solvents. The metal oxide phthalocyanine pigments and the hydroxy or amine groups form a complex which extends the photo-response of an OPC to wavelengths beyond about 850 nm, in order to achieve higher xerographic speed with higher resolution.

19 Claims, 14 Drawing Sheets

638
2.0953
1.6966
1.2979
0.8992
0.5005
0.1018
ABSORBANCE
500
600
700
800
900
1000
1100
Wavelength (nm)

(PVB)

Poly( vinylbutyral-*co*-vinyl alcohol)

(C-1)

(Tetrahydropyranyl bromoethyl ether)

(C-2)

Poly(vinylbutyral-*co*-vinyl tetrahydropyranylethoxy ether)

(MPVB-1)

Poly(vinylbutyral-*co*-vinyl hydroxyethyl ether)

762
1.3949
1.1752
0.9554
0.7357
0.5159
0.2962
ABSORBANCE
500
600
700
800
900
1000
1100
Wavelength (nm)

856
0.9620
0.8235
0.6851
0.5466
0.4081
0.2696
ABSORBANCE
500
600
700
800
900
1000
1100
Wavelength (nm)

(MPVB-3)

PHOTOCONDUCTOR COMPRISING A COMPLEX BETWEEN METAL OXIDE PHTHALOCYANINE COMPOUNDS AND HYDROXY OR AMINE COMPOUNDS

This application is a continuation-in-part of prior, co-pending application Ser. No. 08/634,495, entitled "A PHOTOCONDUCTOR COMPRISING A COMPLEX BETWEEN METAL OXIDE PHTHALOCYANINE COMPOUNDS AND HYDROXY COMPOUNDS", filed Apr. 18, 1996, and issued as U.S. Pat. No. 5,750,300 on May 12, 1998.

FIELD OF THE INVENTION

This invention relates, generally, to a novel method of manufacture and a novel organic photoconductor (OPC) for high speed, high resolution electrophotography. More specifically, this invention relates to an OPC comprising a complex between metal oxide phthalocyanine compounds and hydroxy and/or amine compounds, which operates efficiently with laser wavelengths longer than about 850 nm.

BACKGROUND OF THE INVENTION

Electrophotography

The present invention is related to the photoconductor materials suitable for electrophotography. In the conventional electrophotographic process, electrostatic charge is utilized as the key component for recording information and reading out information. The recording process involves a photoconductive material that must be capable of: a) holding an electrostatic charge in darkness, and b) dissipating this electrostatic charge when exposed to a suitable light source of a wavelength that is strongly absorbed by the photoconductive material. The requirement of holding electrostatic charge can be realized if the photoconductor can exhibit a surface resistivity greater than $10^{13}$ ohm-cm in darkness, i.e. the photoconductor must be a good insulator in the dark. The requirement of releasing the electrostatic charge under light exposure is related to the significant decrease of the surface and the bulk resistivity during the process of light exposure. Thus, the requirements for the xerographic or electrophotographic photoconductor are different from that of photoconductors utilized in opto-electronic devices, such as photodiodes, solar cells, photodetectors, etc.

Electrophotographic processes have been successfully utilized in reprographic, copier, and duplicating products from low speed print-out, in the range of 1–3 pages per minute (ppm), to high speed print-out in the range of above 100 pages per minute.

Electronic Printing Using Electrophotography

Recently, electrophotography has become important in the design of electronic printers. Generally speaking, the electronic printing process utilizing electrophotography is mainly based on synchronizing of the light source, controlled by electrical signal output from a computing device such as computer. The electrical signal turns on or off the light source in order to produce many small dots, which can be developed into visible dots by electrophotographic ink or toner. The selection and collection of these dots form a halftone image.

It should be noted that the basic difference between copying machines and electronic printers, in this case, can be identified by the position at which the toner is deposited. In the copying machine, due to the reflection of the light source from the original image being copied, the toner is attached to the non-exposed area of the photoconductor, which leaves behind the light-exposed area as white background. On the other hand, in electronic printing using electrophotography, toner is attached to the light-exposed area, and thus the light source performs as a writing head or a print head.

Laser Printing Technology Components: Laser, Infrared (IR) Photoconductor

Recently, significant progress in electronic printing has been made, and solid-state opto-electronic devices such as a laser diode or a light emitting diode (LED) have become popular as the optical print head. The laser print head provides much smaller beam diameter than LED, and it is considered a key component for high resolution print-out.

Most laser printer products in the market today utilize single-beam laser scanners. These scanners typically utilize 780 nm wavelength edge-emitting laser diodes and, therefore, there is a lot of effort in development of electrophotographic photoconductors having a suitable response at 780 nm. These conventional photoconductors, typically called infrared or "IR" photoconductors, may include inorganic compounds such as amorphous silicone, dye-sensitized CdS, ZnO, $TiO_2$ and $As_2Se_3$. However, progress in development of organic materials has shown organic photoconductors to have some advantages over inorganic photoconductors in terms of photo-response, cost and ecological concerns.

High-resolution, High-speed Laser Printing Technology Components:

Even though the edge-emitting laser diode exhibits productivity and excellent performance in conventional laser printers products, its applications are limited in the area of higher speed and higher resolution printing. For higher speed printing above 600 DPI, for example, at 1200 DPI, 2400 DPI, or 4800 DPI, a multi-beam scanner is effective. Such multi-beam scanners use laser diodes that are surface-emitting lasers (SEL) instead of edge-emitting diodes. Thus far, the best-performing SEL is one that emits wavelengths longer than 780 nm, for example, wavelengths above 830 nm and preferably in the range of 850 nm–1000 nm.

Therefore, it is an important goal to develop an organic photoconductor (OPC) compatible with long wavelength multi-beam scanners. Such OPC's should be capable of very high speed in the wavelength range between about 850 and 1000 nm.

RELATED ART

IR Photoconductors

Conventional IR photoconductors have included a charge generation layer comprising: an X-form, metal-free phthalocyanine (X—$H_2Pc$), with an absorption maximum of about 790 nm, vanadium oxide phthalocyanine (VOPc), titanium oxide phthalocyanine (TiOPc), or hydroxy gallium phthalocyanine (OHGaPc), with an absorption maximum of about 800 nm. None of these photoconductors exhibit the desired characteristics of having an absorption maximum and enough speed beyond 850 nm. Speed is herein defined as the capability of absorbing at least about 1 erg/sec-$cm^2$ at 850 nm.

TiOPc, VOPc and Secondary Alcohol Additives for OPC's

Examples of OPC's and processes that comprise phthalocyanine appear in several U.S. patents:

- Kinoshita et al. (U.S. Pat. No. 4,994339) discloses an OPC containing a special titanium oxide phthalocyanine crystal with an absorption maximum between 780–860 nm.
- Oda et al. (U.S. Pat. No. 5,114,815) discloses a method for manufacturing an OPC like the one disclosed in Kinoshita et al., above, by dispersing the titanium oxide phthalocyanine in branched ester or alcohol solvents.

Takano et al. (U.S. Pat. No. 5,213,929) discloses a photoconductive crystal formed by mixing titanium oxide phthalocyanine with other phthalocyanines before crystallization.

Tokida et al. (U.S. Pat. No. 5,252,417) discloses a method for making a titanium oxide phthalocyanine which includes a sulfuric acid treatment, followed by a water treatment, and followed by a treatment with aqueous alcohol or aromatic compounds.

Stegbauer et al. (U.S. Pat. No. 5,324,615) discloses a method for manufacturing a vanadium oxide phthalocyanine which includes ball-milling particles of the phthalocyanine less than 0.6 micron for about 4 days in alkyl acetate and poly-vinyl butyral.

Hsiao et al. (U.S. Pat. No. 5,330,867) discloses a method for making a titanium oxide phthalocyanine which includes contacting the phthalocyanine with an aliphatic alcohol at −30°–25° C.

Oshiba et al. (U.S. Pat. No. 5,350,655) discloses an OPC containing a special titanium oxide phthalocyanine which is made by contacting the phthalocyanine with an alkydiol and then with a hydroxyl compound.

SUMMARY OF THE INVENTION

The present invention relates to organic photoconductors (OPC's) and methods of making OPC's comprising a complex between metal oxide phthalocyanine compounds and hydroxy and/or primary or secondary amine compounds. According to the invention, a metal oxide phthalocyanine pigment exhibits extended photo-response between 850 nm and 1000 nm when it is milled with a specific hydroxy and/or amine binder, preferably a modified PVB binder (MPVB) comprising a unit described by the general formula:

(1)

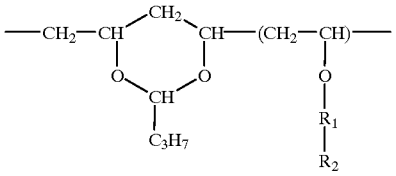

wherein R1=an alkylene, substituted alkylene, arylene, substituted arylene, cycloalkylene, or —C(O)R— group (wherein R is an alkylene, cycloalkylene, or arylene group); and wherein R2=OH or NHR3 (wherein R3 is H, Me, $C_6H_5$, or other alkyl, aryl, or cycloalkyl compounds). For example, in general formula (1), R1 may be:

$CH_2$, $CH_2CH_2$, $CH_2CH_2OCH_2CH_2$, $COCH_2CH_2$,

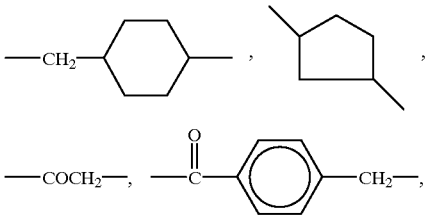

-continued

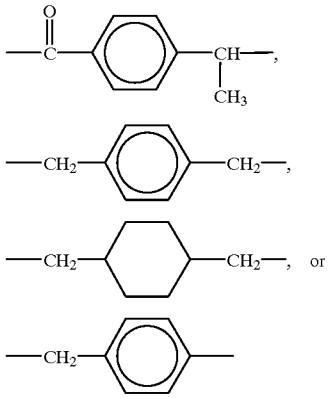

and R2=OH or NHR3; and R3=H, Me, or $C_6H_5$.

Specific amine binders according to this invention, therefore, may be illustrated by the following examples:

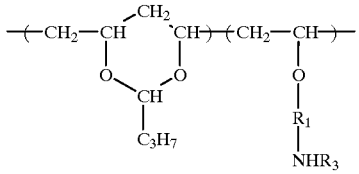

or

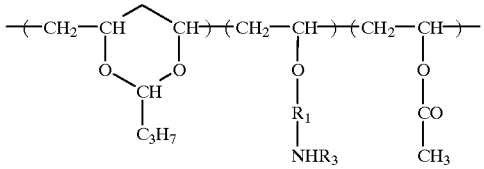

| wherein: $R_1$ is: | and $R_3$ is: |
|---|---|
| —$CH_2$— | H |
| —$CH_2CH_2$— | H |
| —$CH_2CH_2OCH_2CH_2$— | H |
| —$COCH_2$— | H |
| —$COCH_2CH_2$— | H |
| 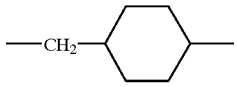 | H |
| 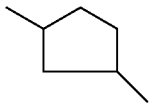 | H |
| 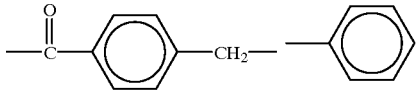 | H |
| 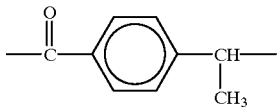 | H |

-continued

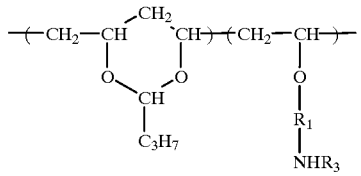

or

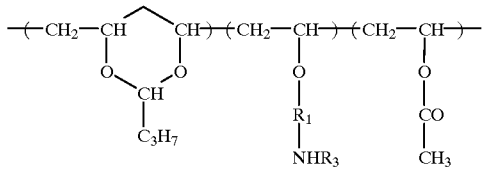

wherein: $R_1$ is: and $R_3$ is:

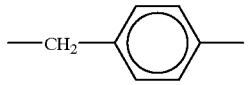

H

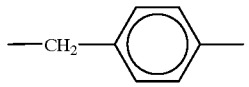

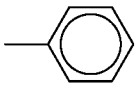

H

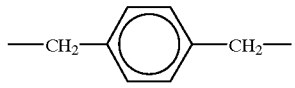

The specific hydroxy and/or amine binders of this invention may be more broadly described to include binders containing:

a) an allyl alcohol monomer unit having the general formula:

$$CH_2=C(R1)—CH_2OH \quad (2)$$

$$CH_2=C(R1)—O—R2—CH_2OH \quad (3),$$

or b) a primary alcohol monomer unit having the general formula:

$$CH_2=C(R1)—COO—R2—CH_2OH \quad (4)$$

$$CH_2=C(R1)—CONH—R2—CH_2OH \quad (5),$$

or c) a secondary alcohol monomer unit having the general formula:

$$CH_2=C(R1)—CH_2O—CH_2—CHOH—CH_2—O(CH_2)m—CH_3 \quad (6),$$

or d) a monomer unit having the general formula:

$$CH_2=C(R1)—CH_2NHR3 \quad (7)$$

$$CH_2=C(R1)—O—R2—CH_2NHR3 \quad (8),$$

or e) a monomer unit having the general formula:

$$CH_2=C(R1)—COO—R2—CH_2NHR3 \quad (9)$$

$$CH_2=C(R1)—CONH—R2—CH_2NHR3 \quad (10),$$

or f) a monomer unit having the general formula:

$$CH_2=C(R1)—CH_2O—CH_2—\underset{CH_3}{CH}—NHR3—CH_2—O(CH_2)m— \quad (11),$$

wherein: R1=H, Me, or F; R2=alkylene, arylene, or cycloalkylene; R3 is H, Me, $C_6H_5$ or other alkyl, aryl, or cycloalkyl groups); and m=0 to 30.

An example of an alternative amine binder, according to this invention, is illustrated by Formula 12, below. Such an embodiment illustrates that the amount of amino group necessary for the complexation with metal oxide phthalocyanine is expected to be very small. For example, in Formula 12, the polymer unit with pendant $—COOCH_2CH_2CH_2NH_2$ group is present at a level of 5%, compared to the polymer unit with pendant $C_6H_5$ group being present a level of 95%.

(12)

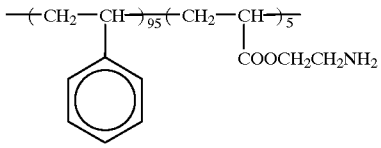

Although the preferred binder is a PVB binder modified to comprises a hydroxy and/or amine group, other specific hydroxy/amine binders according to this invention may be copolymers of most conventional vinyl polymers, such as:

B-1) poly-vinyl acetate

B-2) poly-methylmethacrylate

B-3) poly-butyl methacrylate

B-4) poly-styrene

B-5) poly-vinyl butyral

B-6) poly-vinyl pyrollidon

B-7) poly-vinyl pyridine

B-8) poly-vinyl biphenyl

B-9) poly-vinyl cyclohexane

B-10) poly-norbolinen

B-11) poly-vinyl alcohol with or without conventional substituent groups, including phenolic resins, unsaturated and unsaturated polyesters, poly carbonates, etc Suitable binders are selected based on the solubility criterion of the binders in alcohol-based milling solvents. For example, in a copolymer of poly-vinyl acetate (B-1), the (B-1) content should be in the range between 10–60 wt-%, with the most preferable range of the content of (B-1) in the copolymer being 18–40 wt-%. The binder molecular weight preferably may vary between about 10,000 and 2 millions.

The metal oxide phthalocyanine pigment and the specific hydroxy and/or amine binder form a complex which extends the photo-response of an OPC to longer wavelengths, that is, wavelengths beyond about 850 nm. Thus, an OPC comprising such a complex between the components metal oxide phthalocyanine pigment and hydroxy and/or amine binder may be used to achieve higher xerographic speed with higher resolution at these wavelengths.

The interaction between the metal oxide phthalocyanine pigment and the hydroxy and/or amine binder, and the overall OPC performance, may be enhanced by several additional process steps and components, for example, in the raw pigment preparation and in the milling and the coating processes. Preferably, these process steps and components include: a) preparation of pigment by a special heating process to form a "dehydrated" or "hydroxy-starved" pigment, b) milling the pigment and hydroxy and/or amine binder with optional hydroxy-containing solvents and with optional hydroxy-containing additives.

DETAILED DESCRIPTION OF THE PREFERRED EMBODIMENT

Figure 1:
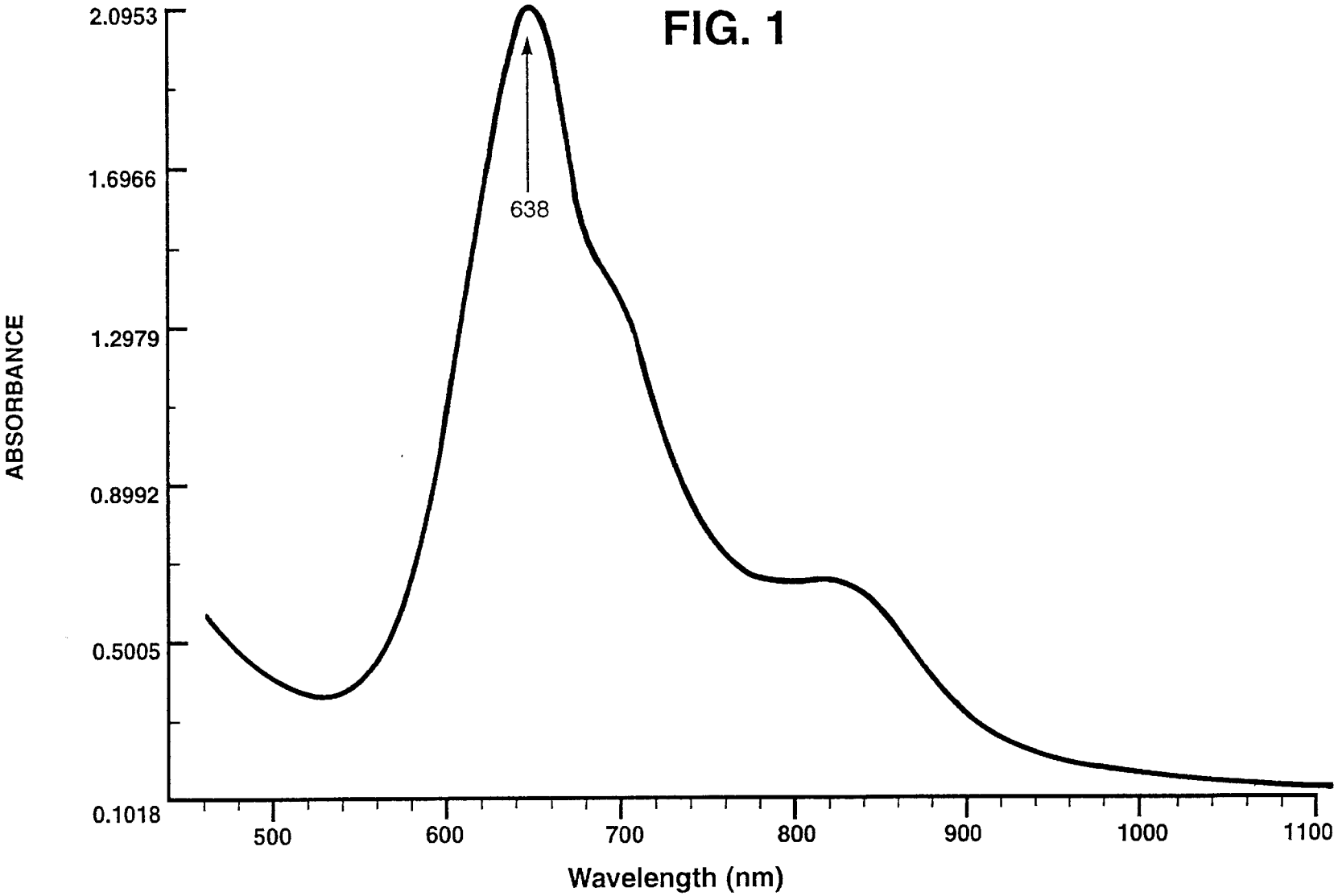
FIG. 1 shows the absorption spectrum of a prior art photoconductive film material of conventional PVB binder and alpha titanyl phthalocyanine pigment, as in Example 1 below.

Referring to the Figures and the following Examples, there are described some, but not the only, embodiments, of the invented electrophotographic photoconductive film layer. The invented film layer, for use in high speed and high resolution OPC's, comprises metal oxide phthalocyanine and a hydroxy and/or amine binder.

A preferred method of making the invented organic photoconductor comprises milling a dehydrated metal oxide phthalocyanine pigment, with a modified PVB binder manufactured. Optionally, alcohol solvents or additives may be selected and added prior to or during the milling.

A dehydrated metal oxide phthalocyanine pigment, such as dehydrated titanyl phthalocyanine (TiOPc) or dehydrated vanadyl phthalocyanine (VOPc), is obtained. Pseudo—alpha phthalocyanine, a transition form between alpha and beta phthalocyanine may be the starting material for producing TiOPc. The raw material TiOPc may be alpha TiOPc, beta TiOPc, X-form TiOPc, Y-form TiOPc, amorphous TiOPc, or salt-milled TiOPc, for example. Also, the raw material VOPc may be different forms of VOPc crystal prepared by the similar treatment techniques available for TiOPc. The hydrated forms of the pigments may be produced by various known processes. For example, hydrated TiOPc may be obtained from the known aqueous procedures including:

i) Acid pasting;

ii) Solvent milling of wet cake;

iii) Salt milling; and iv) TiOPc($H_2O$)m complex.

The dehydrated metal oxide phthalocyanine pigment, herein also called "hydroxy-starved" pigment, is prepared by heating the hydrated forms to high temperature, that is, between about 200–250 ° C. in nitrogen for several hours before milling. Preferably, this heating step lasts about ten hours. This heat treatment process, at such a high temperature prior to the milling step, tends to eliminate the water adsorption on the surface of the pigment. In many cases, it tends to change the morphology and make the pigment into a dried, water-starved form. Other conventional dehydration techniques may also be used. Dehydration herein is defined as reducing the water associated with the metal oxide phthalocyanine to a level below several ppm and is considered a method for obtaining a hydroxy-starved pigment.

Immediately after the heat treatment step, the dehydrated metal oxide phthalocyanine pigment is then preferably wetted with fatty alcohol component(s), specific hydroxy and/or amine binder(s), such as the preferred MPVB, and milling media in order to be subjected to the milling. Under these conditions, it is observed that there is a formation of a complex between the metal oxide phthalocyanine pigment (typically TiOPC and/or VOPc) and the hydroxy components of the fatty alcohols and/or the hydroxy and/or amine binders. "Complex" herein is defined as the formation of a compound wherein at least part of the bonding is by coordination, that is, a central ion or polar group surrounded by an ion(s) or polar group(s).

Thus, milling the dehydrated pigment with the specific hydroxy and/or amine binders of this invention, and preferably with the fatty alcohol solvents and with other optional hydroxy additives, is believed to produce a complex in which the specific hydroxy and/or amine groups surround the oxygen atom. This complexing is believed to be due to the interaction between the —Ti═O group or —V═O group of the pigment with hydroxy and/or amine group(s) of the binder and/or of the alcohol. This kind of interaction is believed to affect the behavior of the lone pair of the nitrogen atoms on the phthalocyanine ring, thus affecting the carrier generation efficiency. Thus, it is believed that the invented method of photoconductor manufacture creates a complex of the specific hydroxy and/or amine groups surrounding the oxygen atom of the —Ti═O or —V═O chromophore, rather than the carbon of the phthalocyanine ring. This complex between the metal oxide phthalocyanine pigment and the hydroxy and/or amine groups of the various components in the milling process results in a charge generation layer exhibiting an absorption maximum in the vicinity of about 850 nm to 890 nm and an excellent photoresponse.

In conventional IR photoconductors, the water molecules adjacent to metal oxide phthalocyanine pigment are believed to affect the stability of the OPC performance. The attachment or detachment of the water molecules, and the consequent interaction between the water and metal oxide phthalocyanine, is believed to cause instability of performance especially at elevated temperature. The complex between pigment and hydroxyl and/or amine groups, according to this invention, is believed to minimize or eliminate the water effect, resulting in stable OPC performance at a high level of photoresponse at greater than about 850 nm.

The fatty alcohols preferably used as milling solvents are defined by the functional group:

$$C_nH_{2n+1}OH \quad (7)$$

where n is equal or greater than three. Fatty alcohol (7) may be normal alcohol, branched alcohol, or ring alcohol, such as:

S-1) Isopropanol (IPA)
S-2) n-BuOH
S-3) Cyclobutanol
S-4) n-pentanol
S-5) 2-pentanol
S-6) 3-pentanol
S-7) 3-methyl 2-pentanol
S-8) 2-methyl-3-pentanol
S-9) 4-methyl-2-pentanol
S-10) 4-methyl-1-pentanol
S-11) Cyclopentanol
S-12) Cyclohexanol
S-13) n-hexanol, or
S-14) a combination of more than one alcohol, for example:
a) IPA/n-BuOH
b) IPA/n-pentanol
c) IPA/cyclobutanol
d) IPA/n-hexanol, or
S-15) a combination of the fatty alcohol with the other conventional solvents if the content of the fatty alcohol in the solvent mixture is greater than 60 vol-%, for example:
a) IPA/ethyl acetate
b) IPA/toluene
c) n-BuOH/butyl acetate
d) IPA/tetrahydrofuran(THF)
e) IPA/toluene/THF
f) n-BuOH/THF/toluene.

Optional hydroxy additives may be added into the milling system by using secondary alcohols as milling solvents. Such hydroxy additives include, for example:

A-1) 3-hydroxy-2-butanone
A-2) 2-hydroxy fluorene
A-3) 1-indanol
A-4) 2-indanol
A-5) 5-indanol
A-6) Benzhydrol
A-7) 1,1-Diphenyl-2-propanol
A-8) D-Fructose, or
A-9) a combination of metal oxide pigment with hydroxy phthalocyanine pigments including:
1. Titanium oxide phthalocyanine, and
2. Vanadium oxide phthalocyanine, as metal oxide pigments, and
i) Hydroxy aluminum phthalocyanine pigment,
ii) Hydroxy gallium phthalocyanine pigment, and
iii) Hydroxy yttrium phthalocyanine pigment, as hydroxy phthalocyanine pigments.

The range of solid hydroxyl additives in the milling mixture is preferably about 0.1 wt-% to 40 wt-%.

Other optional additives may include a crosslinker, which can cause a crosslinking reaction between excess hydroxy and/or amine groups of the specific hydroxy and/or amine binders or it can link the hydroxy and/or amine groups of the additives with the hydroxy and/or amine groups of the binder. These other additives may be:

0-1) diisocyanate compounds
0-2) polyisocyanates
0-3) dialdehydes
0-4) trialdehydes
0-5) melamine resin
0-6) epoxy resin, or
0-7) any reactive functional group with —$CH_2OH$ or —CHOH group in the binder.

Milling conditions are preferably set to promote the reaction between the metal oxide phthalocyanine pigment and hydroxy and/or amine group of the specific binders. Devices that may be used include: paint-shakers, homogenizers, attritors, ball mills, sand mills, etc These devices may be used with various kinds of milling media, including ceramic beads (for example, zirconium or alumina), glass beads, or steel stainless beads. The milling time, in some cases, needs to be extended from several hours to several days in order to give enough reaction time between metal oxide phthalocyanine pigments and hydroxyl and/or amine groups of the specific binders or hydroxyl additives. The milling temperature is controlled between room temperature and 75° C. using a water jacket fitted onto the milling vessel or using hot air in the milling chamber where the milling vessel is located.

A baking or drying step may be included after the milling process, for removal of coating solvents, as well as to promote crosslinking, if necessary. The baking conditions may be a temperature ranging from 35° C. to 300° C. and a time ranging from several minutes to several hours, depending, for example, on the solvents and crosslinking additives used.

The preferred composition of matter and methods of manufacture produce an OPC with excellent photoresponse at greater than about 800 nm, and preferably at about 850 nm or higher, for use in high speed, high resolution EP. As illustrated by the following Examples, the preferred embodiment comprises:

a) dehydrated or hydroxy-starved metal oxide phthalocyanine pigment, b) specific hydroxy and/or amine binders, preferably a modified PVB according to general Formula (1) above;

c) optional hydroxy solvents, d) optional hydroxy additives, and e) specific milling and manufacturing conditions, resulting in a complex of pigment and hydroxy and/or amine compounds.

EXAMPLES

Example 1

Prior Art Preparation 15 g of alpha titanyl phthalocyanine (for example, from W. W. Sander Co., U.S.A.), 7.5 g of conventional poly-vinyl butyral binder (B98, Monsanto Chemical) and 190 g of methanol were milled together in a ceramic pot using ceramic beads (3mm diameter) for 72 hrs using a ball mill. The product was a blue slurry suspension, which was diluted further with isopropanol to yield a dispersion of 5 wt % solid. A wound wire bar was utilized to cast a film of 1 micron of the slurry on a transparent mylar substrate and this film was dried in the oven at 60° C. for 2 hours. The absorption spectrum of this film material, illustrated in FIG. 1, shows a maximum absorption at 638 nm.

Example 2

Figure 2:
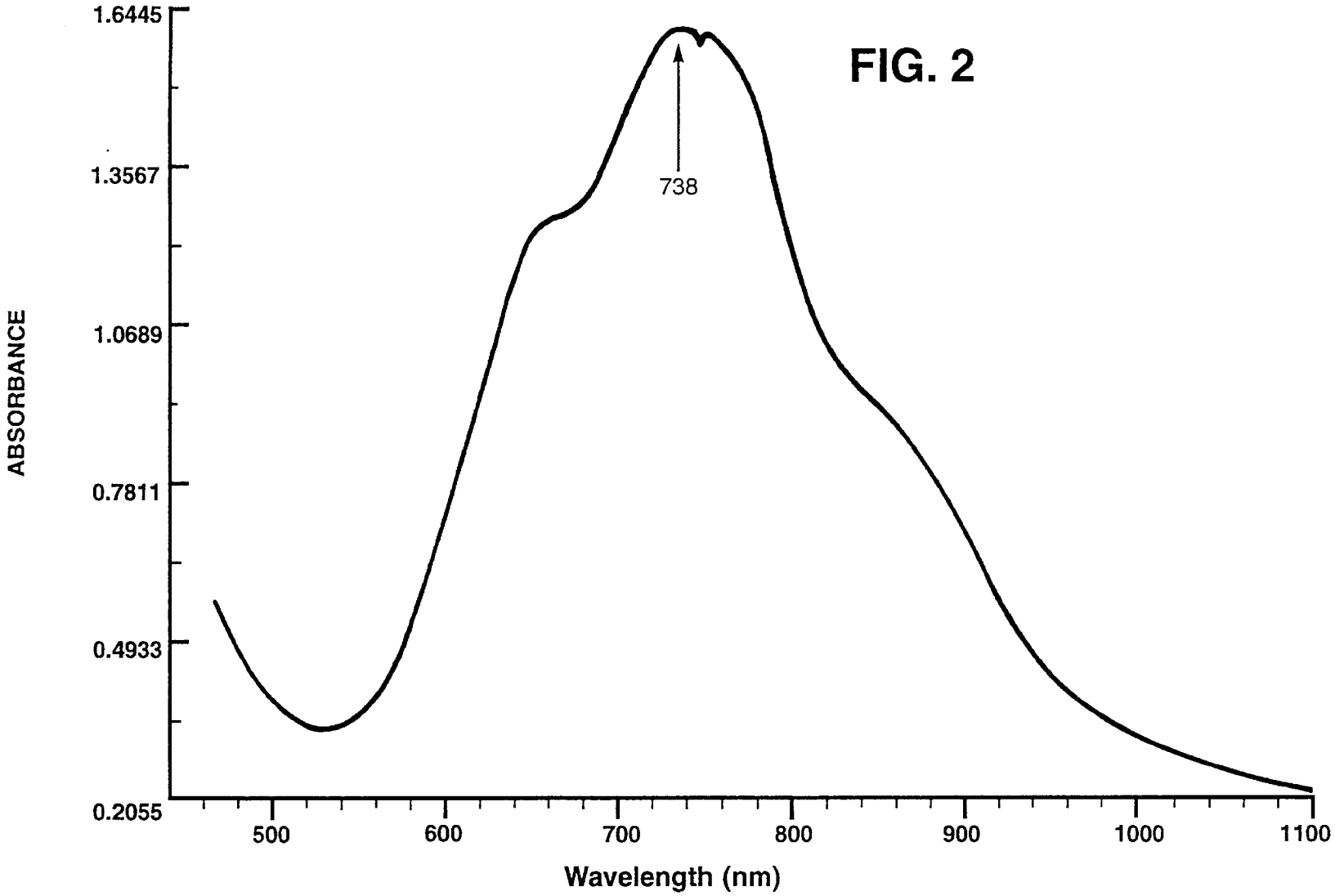
FIG. 2 shows the absorption spectrum of a photoconductive film material according to one embodiment of this invention, using PVB and dehydrated pigment, as in Example 2 below.

Preparation with Hydroxy-Starved (Dehydrated) Pigment 15 g of alpha titanyl phthalocyanine (W. W. Sander Co., U.S.A) was dry milled in a ceramic pot using 3 mm diameter ceramic beads for 2 days. The long needle titanyl crystal turned into a dark blue powder. The whole system (powdery pigment and beads) was transferred into a recrystallization disk and baked in an oven at 220° C. for 2 hours. This step was taken to make sure that the residue solvents from the raw materials were driven out completely from the ground pigment, as indicated by no solvent vapor smell being detected. At the end of the baking process, the baked powder pigment and beads were immediately transferred back to the above ceramic milling jar containing 197.5 g of poly-vinyl butyral B98 (3.6% solid in methanol) and the system was wet milled for 72 hours. The suspension was adjusted to 5 wt % solid by dilution with isopropanol. The specimen for spectroscopic study was prepared in the same manner as described in Example 1. The absorption spectrum of this material, illustrated in FIG. 2, indicates an absorption max at 738 nm, that is, about a 100 nm red shift, relative to Example 1.

Example 3

Preparation of Modified Poly-vinyl Butyral (MPVB-1)

In a 500 ml round flask, 25 gr of poly-vinyl butyral B98 ("PVB") (Monsanto Chemical), 12.5 gr of tetrahydropryanyl bromoethylether (C-1 in FIG. 3), 42 gr of potassium carbonate ($K_2CO_3$) and 150 gr of tetrahydrofuran (THF) were vigorously stirred for 24 hours with $N_2$ gas bubbles at 80° C. Afterward, the system was diluted with 200 gr THF and precipitated in 71 ml distilled water to achieve the compound poly (vinylbutyral-co-vinyl tetrahydropyranyletheroxy ether) (C-2 in FIG. 3), confirmed by NMR.

Figure 3:
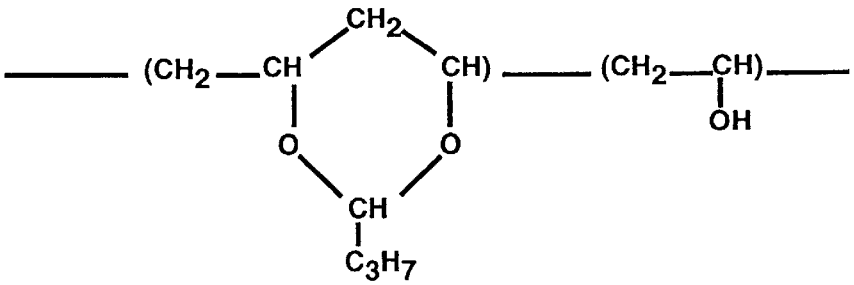
FIG. 3 shows a reaction scheme, according to one embodiment of the invention, for preparing a modified PVB binder having a —CH2CH2OH unit (MPVB-1), as in Example 3 below.
Figure 3:
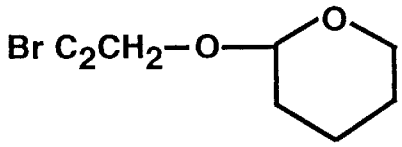
Figure 3:
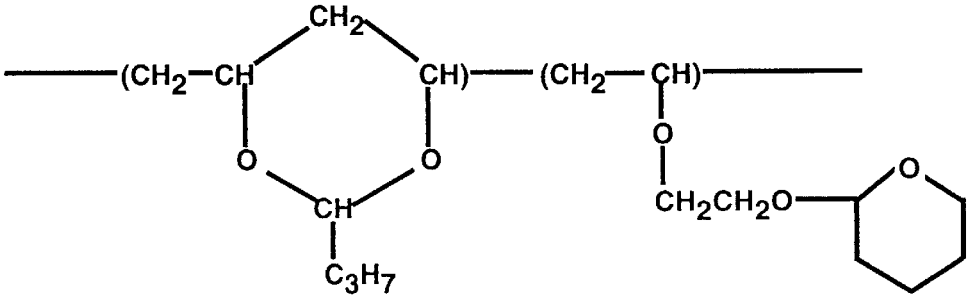
Figure 3:
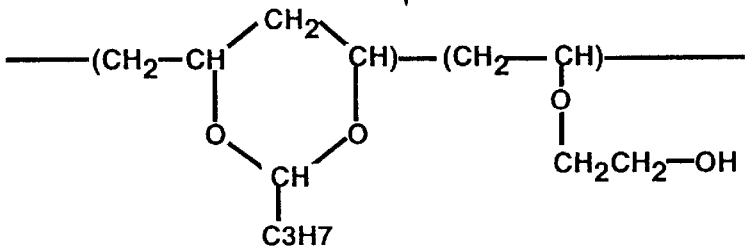

Next, 20 gr of C-2 was redissolved in 265 gr THF, 17 ml distilled water and 17 drops of 10% HCL from a 5 ml pipet. Then, the whole system was stirred at room temperature for 18 hrs. The system was then precipitated in 3.5 l of distilled water. The white solid was dried at room temperature for two days and then redissolved in 157 g isopropanol (IPA) and precipitated again in 21 ml heptane to give rise to the final product poly(vinylbutyral-covinyl hydroxy ethyl ether) ("MPVB-1" in FIG. 3) which was dried in an oven at 60° C. for 24 hours. This reaction scheme is illustrated in FIG. 3.

Example 4

Figure 4:
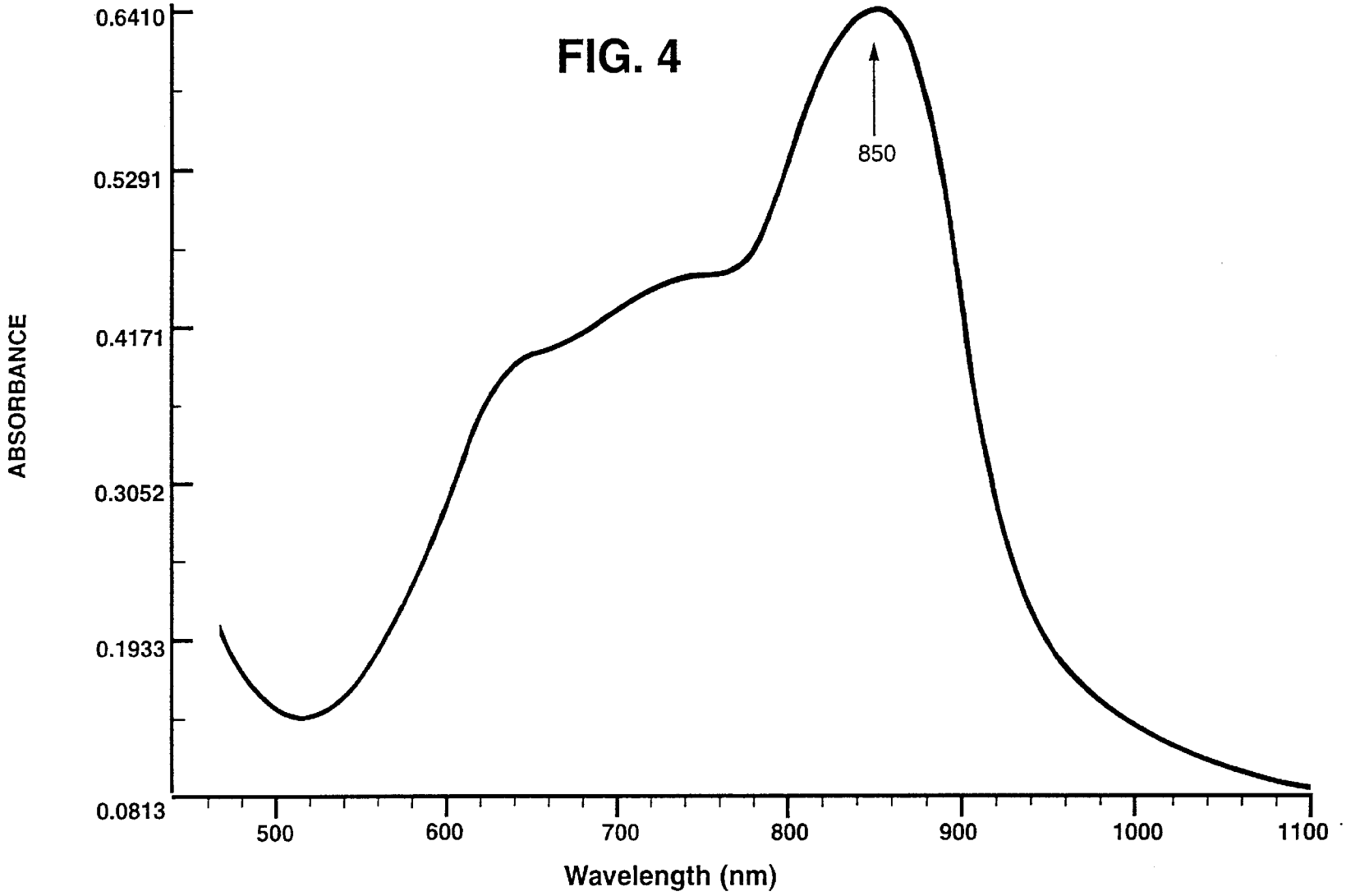
FIG. 4 shows the absorption spectrum of a photoconductive film material according to another embodiment of this invention, utilizing a complex between MPVB-1 binder and dehydrated pigment, as in Example 4.

Effect of the Modified Poly-vinyl Butyral (MPVB-1) with Hydroxy-Starved Pigment Example 2 was repeated, except that the poly-vinyl butyral B-98 was replaced by the modified poly-vinyl butyral (MPVB-1) as prepared in Example 3. The absorption spectrum for this material is illustrated in FIG. 4. It was observed that, in this case the absorption max was at 850 nm, i.e., another red shift of about 112 nm due to the specific functional group —$CH_2CH_2OH$ instead of —H functional group in the alcohol unit of the conventional PVB.

Example 5

Figure 5:
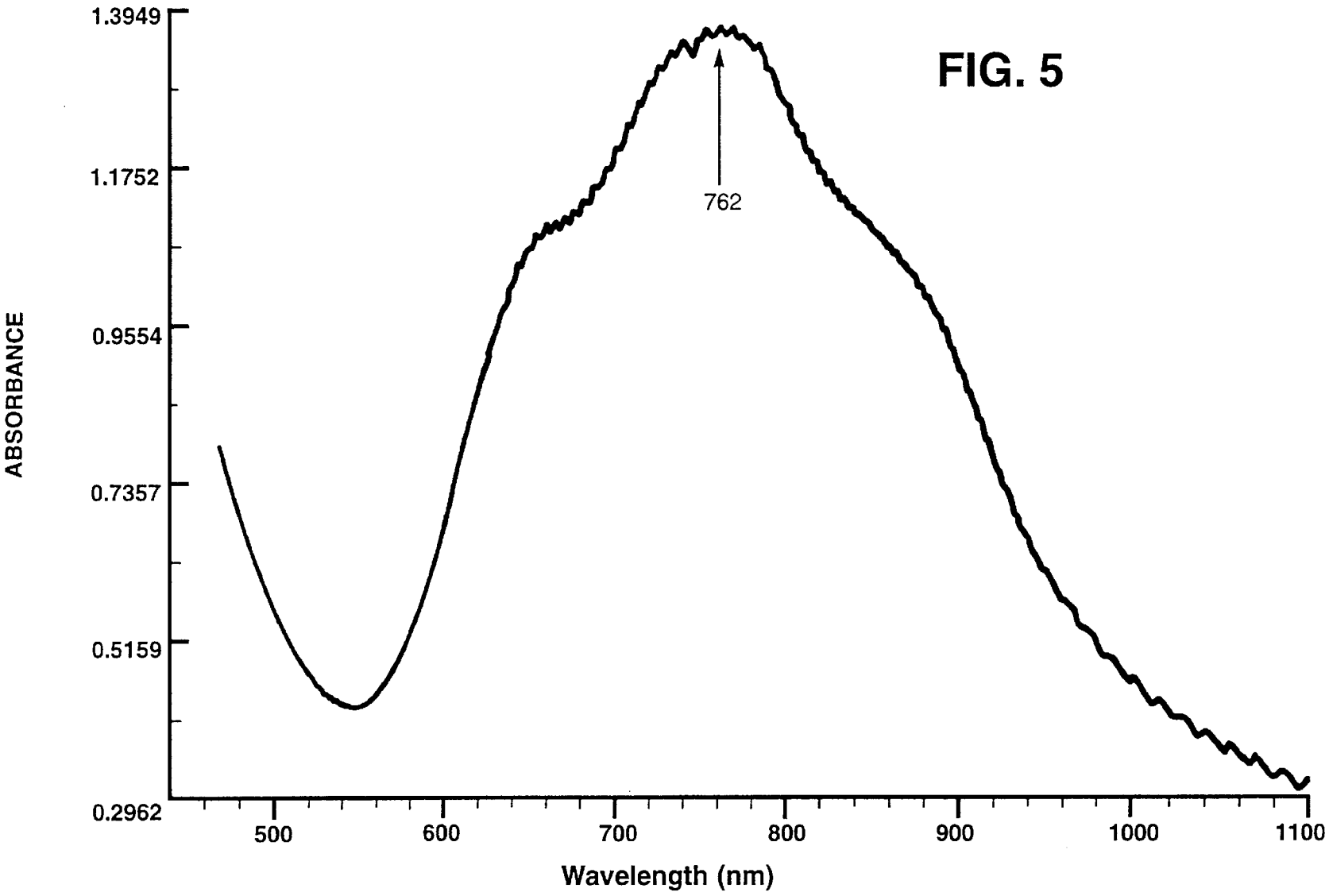
FIG. 5 shows the absorption spectrum of a photoconductive film material according to another embodiment of this invention, utilizing a complex between MPVB-1 binder and non-dehydrated pigment, as in Example 5.

Study the Effect of the Modified PVB (MPVB-1) with Non-Hydroxy Starved Pigment Example 4 was repeated, except that the alpha titanyl phthalocyanine pigment was not pre-treated (that is, using the same pigment as utilized in Example 1). The absorption spectrum for the resulting material is illustrated in FIG. 5. This case of MPVB-1 with non-hydroxy-starved pigment exhibited a spectrum with a maximum between the maxima for Examples 1 and 4, that is, a moderate blue shift relative to MPVB-1 with hydroxy-starved pigment (762 nm vs. 850 nm max.), and with a red shift compared to conventional PVB with non-hydroxy-starved pigment (762 nm vs. 638 nm max.). Thus, the FIG. 5 spectrum indicates that a new complex was formed between the alpha titanyl pigment and the specific poly-vinyl butyral having the specific unit —$CH_2CH_2OH$, that is, the modified PVB made as described in Example 3.

Example 6 (A)

Figure 6A:
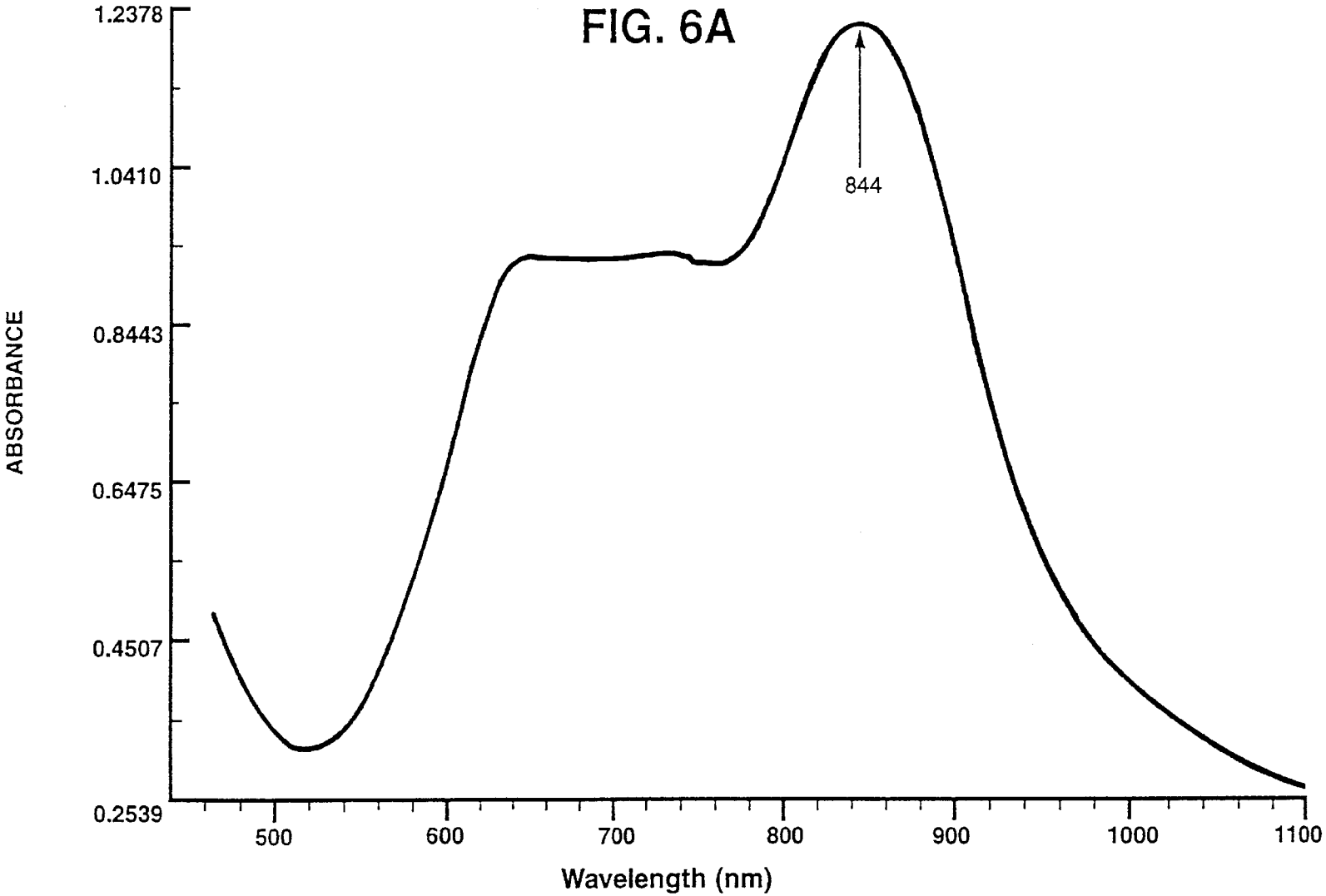
FIG. 6A shows the absorption spectrum of a photoconductive film material according to another embodiment of this invention, utilizing a complex between MPVB-1 binder and dehydrated pigment, with cyclopentanol additive during the milling step, as in Example 6A.

Co-effect of Hydroxy-Starved Pigment, MPVB-1 and Specific Hydroxy Compound Additives Example 4 was repeated, except that cyclopentanol was used as the milling solvent instead of methanol (MeOH). The absorption spectrum for the material resulting from this example is illustrated in FIG. 6A and exhibits an absorption maximum at 844 nm. This spectrum exhibits a maximum very close to, but with a slight blue shift relative to, what was observed in Example 4 (FIG. 4).

Example 6 (B)

Figure 6B:
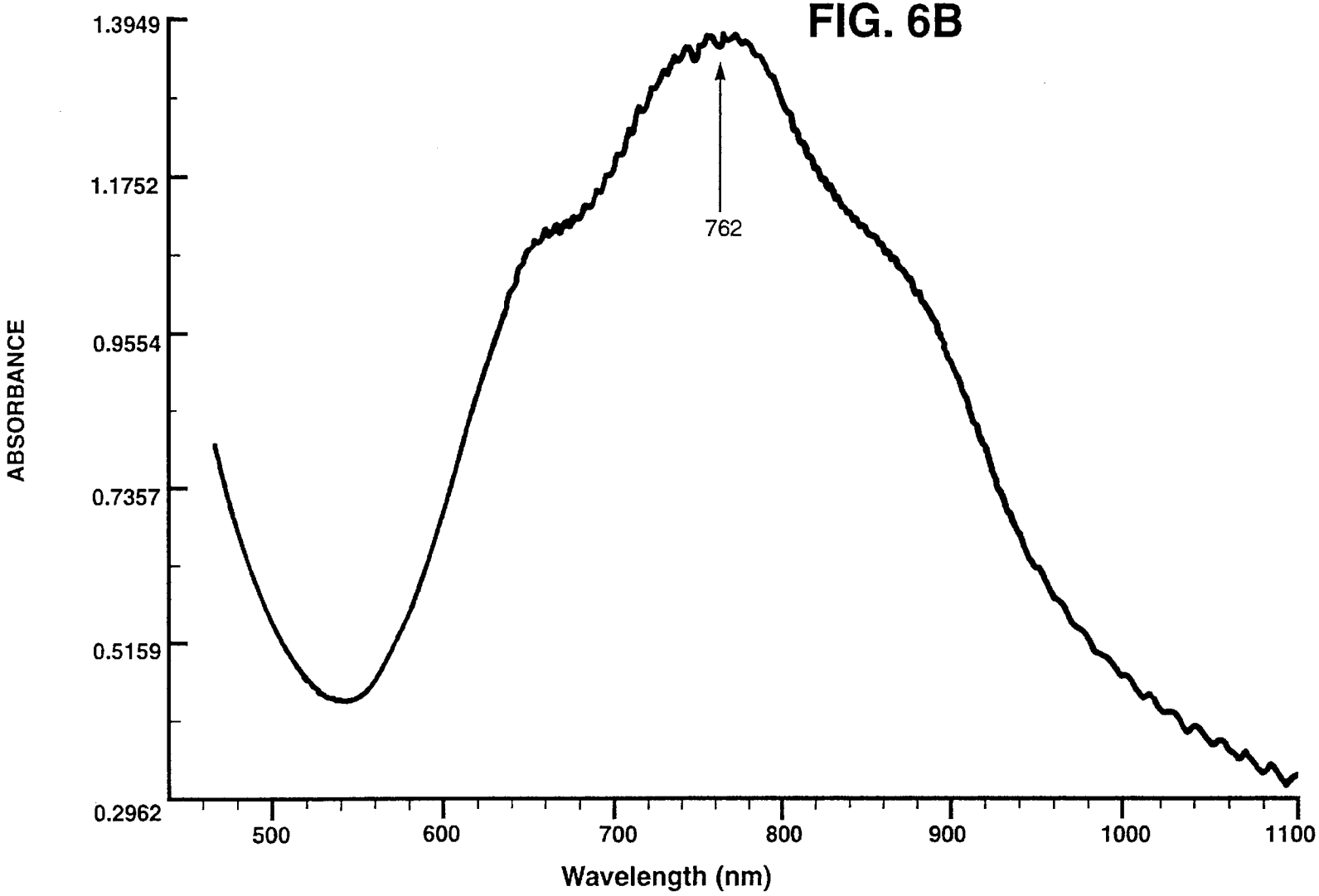
FIG. 6B shows the absorption spectrum of a photoconductive film material according to another embodiment of this invention, utilizing a complex between MPVB-1 binder and dehydrated pigment, with 2,3-butane-diol additive during the milling step, as in Example 6B.

Co-Effect of Hydroxy-Starved Pigment, MPVB-1 and Specific Hydroxy Compound Additives Example 6(A) was repeated, except that 1.5 g of 2,3-butane-diol was added before milling. The absorption spectrum of the material resulting from this example is illustrated in FIG. 6B, with an absorption maximum at 740 nm. This indicates clear evidence that a complex was formed between the hydroxy-starved titanyl phthalocyanine pigment and the 2,3-butane-diol additive, resulting in a blue shift of the absorption max from 844 nm to 740 nm.

Example 6 (C)

Figure 6C:
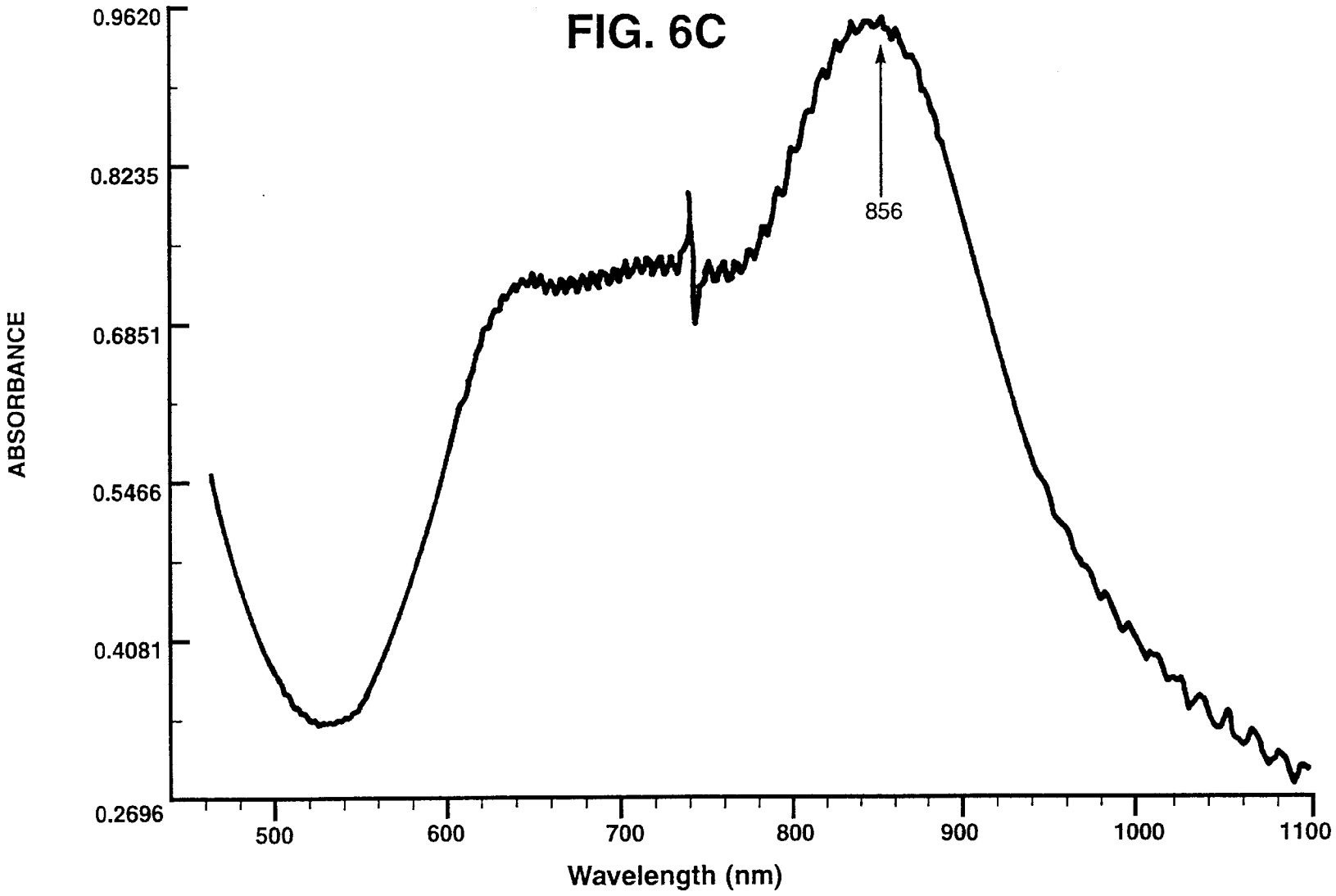
FIG. 6C shows the absorption spectrum of a photoconductive film material according to another embodiment of this invention, utilizing a complex between MPVB-1 binder and dehydrated pigment, with 1,4-cyclohexane-diol additive during the milling step, as in Example 6C.

Coeffect of Hydroxy-Starved Pigment, MPVB-1 and Specific Hydroxy Compound Additives Examples 6(B) was repeated, except that 1,4-cyclohexane-diol was used instead of 2,3-butane-diol. The absorption spectrum is illustrated in FIG. 6C, with an absorption maximum at 856 nm. This Example provides additional evidence of a strong interaction between the hydroxy-starved pigment and a specific hydroxy additive, such as 1,4-cyclohexane-diol. This interaction is believed to form a complex of titanyl phthalocyanine and the specific hydroxy compound.

Example 7

Preparation of Titanyl Phthalocyanine A-form

Freshly distilled quinoline (480 ml) was poured into a 1 liter round bottom flask. The flask was purged with $N_2$ for 15 minutes. Next, 30.59 g of tetraisopropoxy titanium (Ti $(OPr)_4$ from Tokyo Kasei was added to the quinoline and purged with $N_2$ gas another 20 minutes. 62.49 g of diiminoisoindoline was weighed in a nitrogen-filled glove bag and transferred to the quinoline solution. Immediately, heating was started. The solution turned yellow-orange and then light brown. The reaction temperature was kept at 180° C. for 6 hours, then reduced to room temperature. The solid was filtered under vacuum and washed with quinoline, hot dimethylaniline, and IPA in succession, and dried at 115° C. for 24 hours. The product was a dark-blue color, with a yield of 85%.

Example 8

Figure 7:
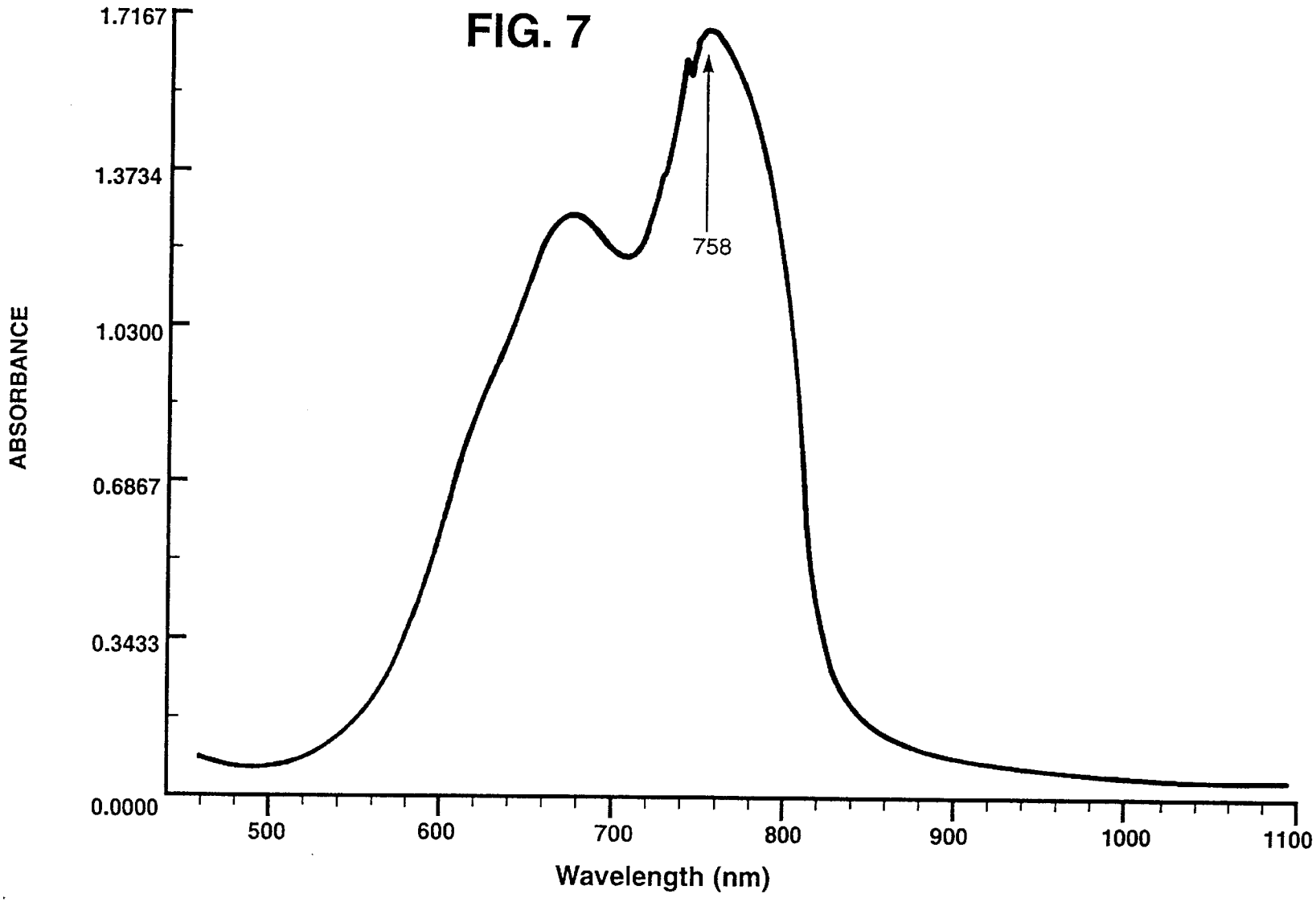
FIG. 7 shows the absorption spectrum of a photoconductive film material according to another embodiment of this invention, as in Example 8, using PVB and a dehydrated form of the Titanyl Phthalocyanine A-form pigment made according to the method of Example 7.

Example 2 was repeated, except that the alpha titanyl phthalocyanine raw material was replaced by the pigment prepared in Example 7 and the methanol was replaced by cyclopentanol. The absorption spectrum is illustrated in FIG. 7 with absorption max. at 758 nm.

Example 9

Figure 8:
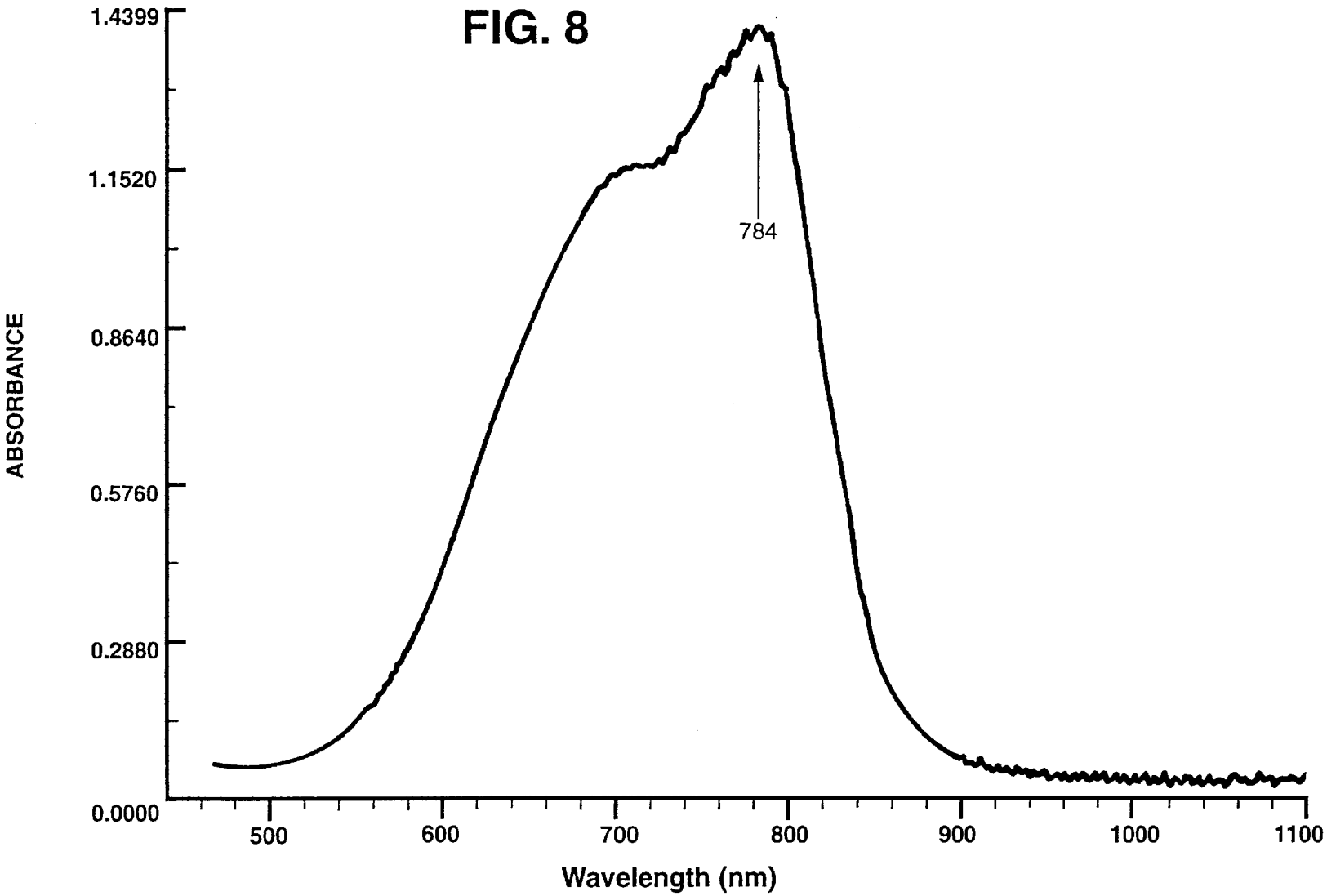
FIG. 8 shows the absorption spectrum of a photoconductive film material according to another embodiment of this invention, as in Example 9, using MPVB-1 and a dehydrated form of the Titanyl Phthalocyanine A-form pigment made according to the method of Example 7.

Example 8 was repeated, except that the conventional PVB was replaced by the modified PVB having —$CH_2CH_2OH$ unit (MPVB-1 described in Example 3). The absorption spectrum is illustrated in FIG. 8 with maximum at 784 nm.

Example 10

Measurement of Photoconductivity

All of the dispersions of the complex of titanyl phthalocyanine pigment and the specific hydroxy binder or additives of these examples were used to prepare a thin charge generation layer (CGL) on an Al Mylar substrate. The CGL was made by coating the dispersion solution with a doctor blade to achieve a thickness of 0.5 micron on the substrate after being dried in an oven at 100° C. for 2 hours. In alternative embodiments of the invention, various methods of forming a charge generation layer as a portion of an OPC may be used.

In order to form a charge transport layer, 4 g of p-tolylamine and 6 g of polycarbonate Lexan 114 (General Electric) were dissolved in 990 g of dichloromethane/1,1,2-trichloromethane (60/40 ratio) mixed solvent. This solution was coated on the top of CGL, using a doctor blade to achieve a thickness of 20 $\mu$m after being dried at 100° C. for 4 hours.

The xerographic properties of the samples were measured using Cynthia OPC testing system (prepared by Gentek Company, Japan). In this set-up, the well-grounded photoconductor sample was mounted on the surface of an aluminum drum, which was exposed to a negative corona charging system operated at approximately −600V for 5 seconds and the surface potential Vo was read by a surface probe TREK 362. The surface charge was let decay in the dark for 5 seconds to measure the dark decay rate DDR=(Vo-V)/5 (V/s) in which the value V was also measured by a similar probe meter. Next, the charged photoconductor was exposed to a monochromatic light source with incident energy set at I=1 ergs/$cm^2$. The xerographic response of the photoconductor sample was read by the energy required to discharge 80% of the initial potential V at the maximum absorption wavelength, as recorded in Table 2 below as "Xerographic Speed". So, the higher the energy required, the slower the photoresponse. And the residual potential was read by Vr(V) after stopping the exposure. The results are illustrated in Table 2 below.

Example 11

Preparation of Poly-vinyl butyral with Cyclohexanol-Containing Pendant Group (MPVB-2)

Modified polyvinylbutryal containing a pendant group with cyclohexanol was prepared by the reaction of PVB with tetrahydropyranyl (THP) protected bromomethylcyclohexanol, followed by acid hydrolysis of the THP protection group. The THP-protected cyclohexanol-containing moiety was prepared by the following reaction sequence: 4-Methoxycyclohexanoic acid was reduced with borane-tetrahydrofuran complex to obtain 4-bromomethyl-cyclohexanol. This compound was treated with phosphorus tribromide to obtain the corresponding bromo compound. This bromo compound was reacted with trimethylsilyliodide to cleave the methoxy group to obtain 4-bromomethyl-cyclohexanol, which in turn was treated with dihyhdropyran to obtain the tetrahydropyranyl-protected bromomethylcyclohexanol. This preparation is represented by the following reaction scheme and further described in paragraphs a–d below.

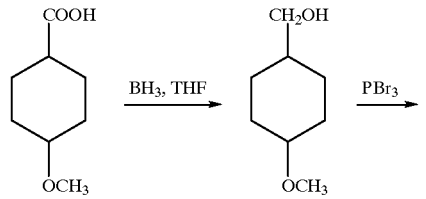

(C-3)

-continued

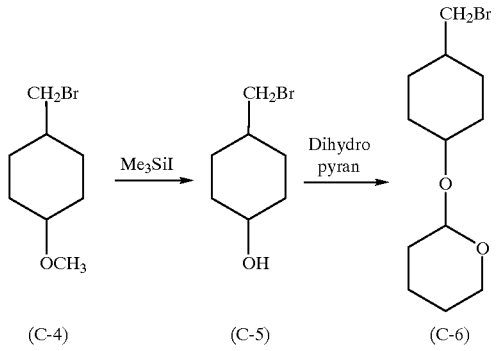

a) Preparation of 4-bromomethylcyclohexanol (C-3):

4-Methoxycyclohexanoic acid (13.0 g) was dissolved in THF (20 g), and cooled with ice. Then, borane-tetrahydrofuran complex (80 ml of 1M solution) was added and stirred overnight. Excess borane was destroyed by adding 15 ml of water dropwise until no effervescence was observed. The solution was then neutralized with potassium carbonate. The THF layer was dried over anhydrous magnesium sulfate and filtered. The solvent from the filtrate was removed under vacuum to obtain the desired 4-methoxycyclohexylmethanol (12.0 g).

b) Preparation of bromomethyl-4-methoxycyclohexane (C-4):

4-Methoxycyclohexylmethanol (10.5 g) was dissolved in carbon tetrachloride (45 g) and cooled with ice. Phosphorus tribromide (2.8 ml) was added dropwise to the above solution and stirred at ambient temperature overnight. The carbon tetrachloride layer was decanted and dried over magnesium sulfate. After filtering, the carbon tetrachloride from the filtrate was evaporated to yield pale yellow colored liquid of bromomethyl-4-methoxycyclohexane.

c) Preparation of 4-bromomethylcyclohexanol (C-5):

The 4-methoxycyclohexylbromomethane compound (C-4) (2.6 g) in chloroform (7.8 g) was cooled with ice. Then trimethylsilyliodide (2.2 ml) was transferred to the C-4 solution. It was stirred at ambient temperature for 8 h, and then quenched with methanol. Then, volatiles were removed to obtain the desired alcohol in almost quantitative yield.

d) Preparation of tetrahydropyranyl bromomethylcyclohexyl ether (C-6):

4-Bromomethylcyclohexanol (C-5) (3.0 g) and dihydropyran (2.6 g) were mixed together and cooled with ice. A tiny drop of 10% hydrochloric acid was added. Exothermic reaction occurred and stirred at ambient temperature overnight. The solution was neutralized with potassium carbonate and extracted with dichloromethane (50 ml). It was filtered and then dichloromethane from the filtrate was evaporated to yield the compound C-6, tetrahydropyranyl bromomethyl-cyclohexyl ether (5.0 g).

Figure 9:
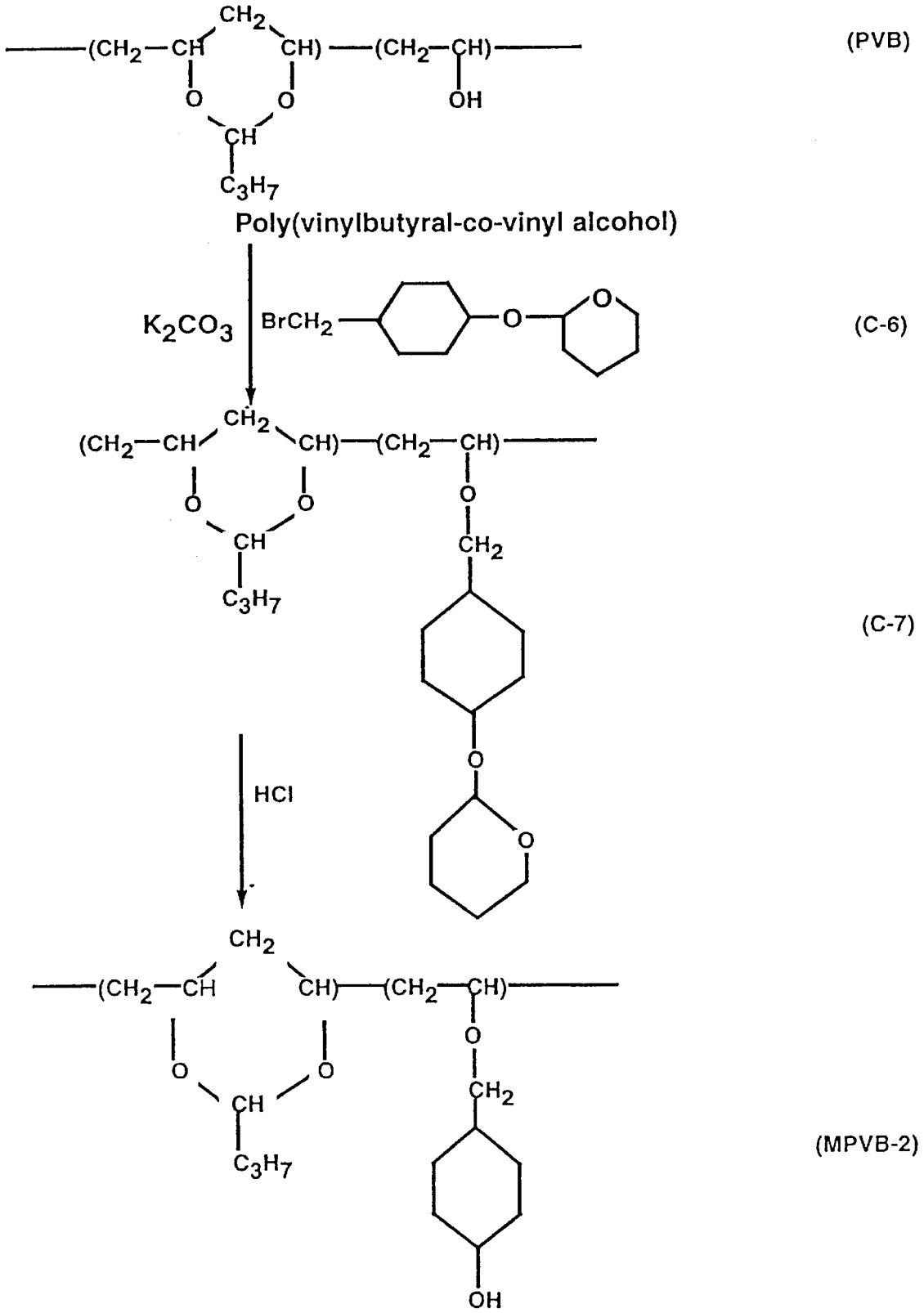
FIG. 9 shows a reaction scheme, according to another embodiment of the invention, for preparing a modified PVB binder having a cyclohexanol unit (MPVB-2), as in Example 11.

As shown by the following reaction scheme in FIG. 9 and paragraphs e and f below, compound C-6 and PVB were then reacted to form an intermediate polymer, which was then reacted to form the desired modified PVB with cyclohexanol unit ("MPVB-2").

e) Reaction of polyvinylbutral with tetrahydropyranyl bromomethylcyclohexyl ether:

Polyvinylbutral (2.9 g) was dissolved in THF (35.0 g) and mixed with potassium carbonate (6.55 g) and tetrahydropyranyl bromomethylcyclohexyl ether (5.1 g). This mixture was refluxed for 19 h at 80° C. It was diluted with THF (48 g) and centrifuged. The clear THF solution was added dropwise to water (1 L) to precipitate the intermediate polymer (C-7). The precipitated C-7 polymer was washed with water and dried in air for 24 h.

f) Preparation of PVB containing cyclohexanol unit:

About 5 g of the intermediate polymer (C7) obtained above was dissolved in THF (50 g). Water (2 ml) was added followed by 3 small drops of a 5 ml polyethylene pipett. The solution was stirred at ambient temperature for 20 h, then precipitated in water (1.3 L). The precipitated polymer was dried in air overnight at ambient temperature. This polymer was again dissolved in THF (40 g), and then precipitated in heptane (2 L). The precipitated polymer was dried at 70–95° C. for 2 days to yield the desired polymer, MPVB-2.

Example 12

Figure 10:
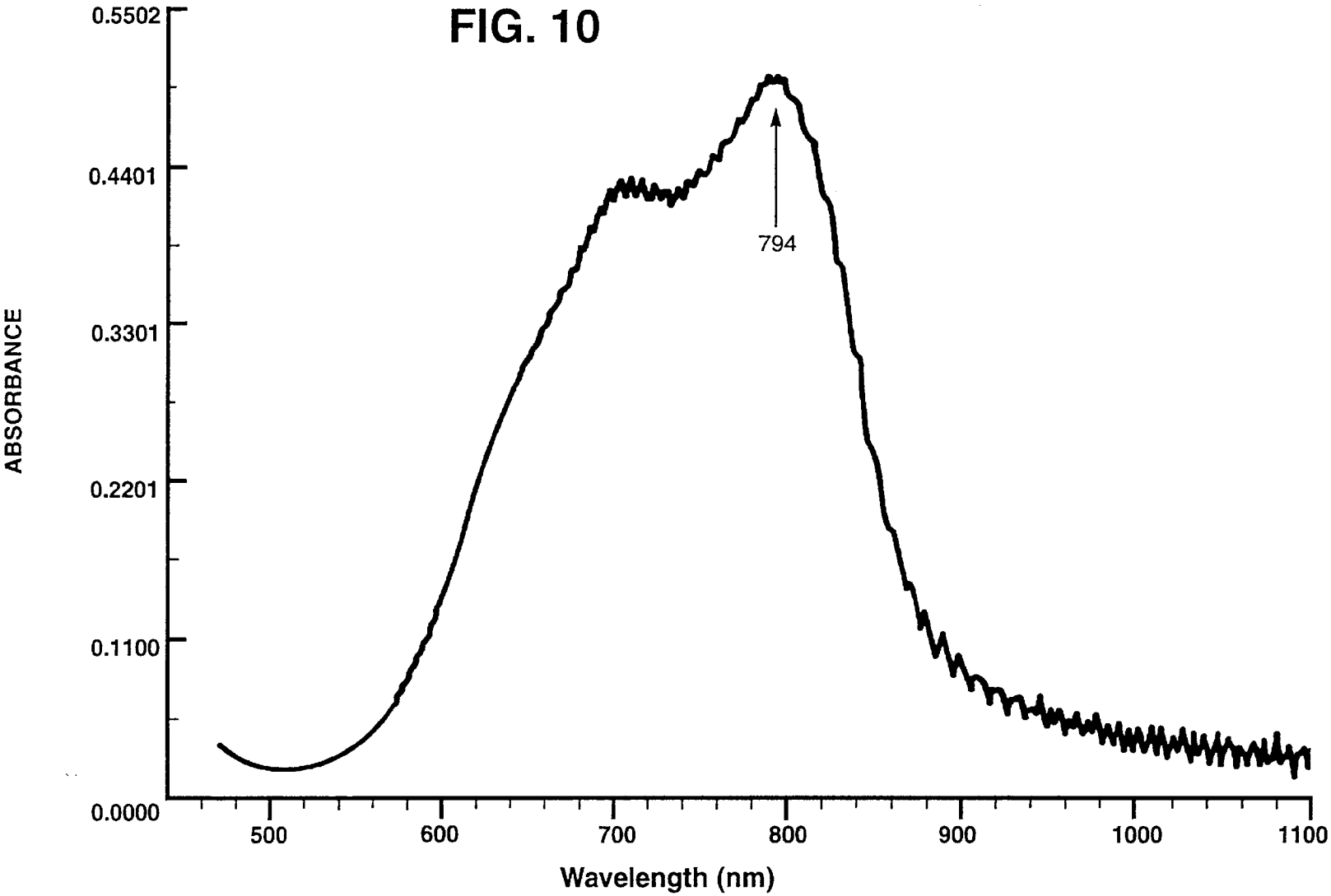
FIG. 10 shows the absorption spectrum of a photoconductive film material according to another embodiment of this invention, as in Example 12, using MPVB-2 and a dehydrated form of the Titanyl Phthalocyanine A-form pigment made according to Example 7.

Preparation of the OPC using butyral containing cyclohexanol unit:

Example 8 was repeated, except the conventional PVB was replaced by the modified polyvinyl butyral containing cyclohexanol unit, MPVB-2 made according to Example 11. The absorption spectrum is illustrated in FIG. 10 with maximum at 794 nm, and xerographic data is shown in Table 2.

Example 13

Example 12 was repeated, except that the titanyl phthalocyanine A was replaced by vanadyl phthalocyanine VOPc (Kodak Cat). The absorption maximum was 820 nm.

Example 14

Example 8 was repeated, except that TiOPc was replaced by VOPc. The absorption maximum was 790 nm.

Example 15

Figure 11:
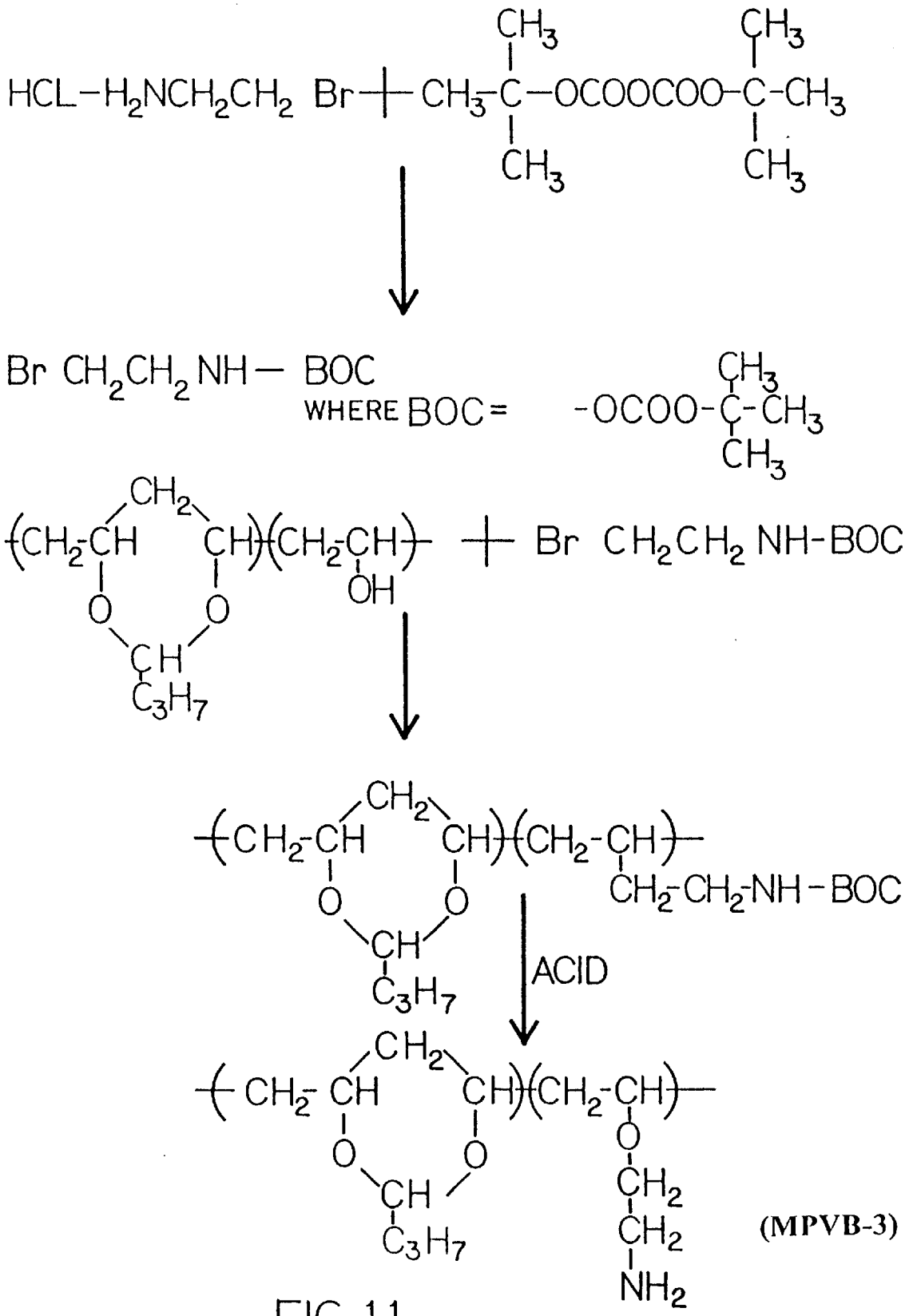
FIG. 11 shows a reaction scheme, according to one embodiment of the invention, for preparing an amine-modified PVB binder (MPVB-3), having a —$CH_2CH_2NH_2$ unit, as in Example 15 below.
Figure 12A:
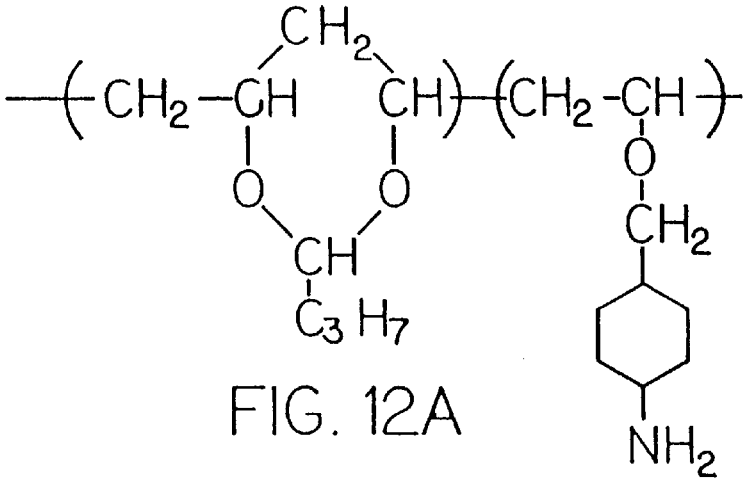
FIGS. 12A, B, and C show alternative embodiments of an amine-modified PVB binder according to the invention.
Figure 12B:
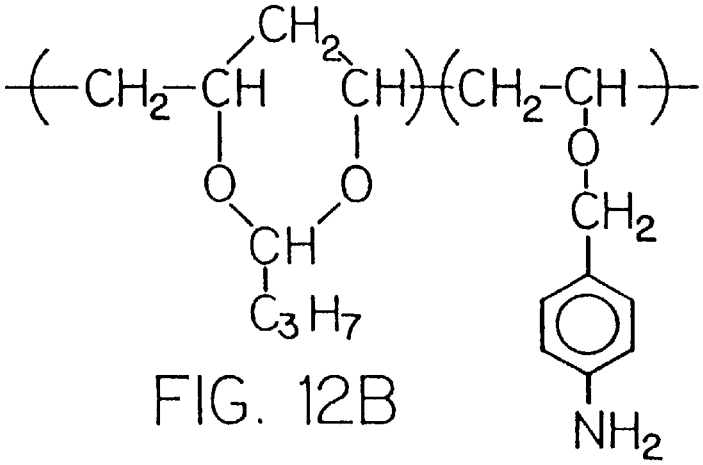
Figure 12C:
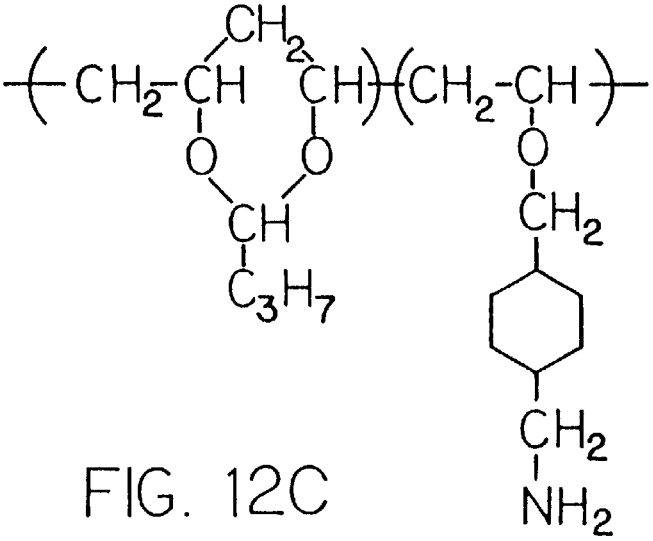

Preparation of an alternative specific binder, an amine-containing binder, is illustrated in FIG. 11. This example of an amine binder is designated MPVB-3 and may be made by the steps shown in FIG. 11. In summary, a commercially available 2(PVB may be reacted with $BrCH_2CH_2NH$—BOC (where BOC=—$OCOOC(CH_3)_3$), and then reacted with an acid to obtain:

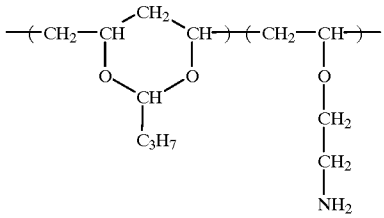

TABLE 1

Comparison of Absorption Maxima

| Example | Method | Absorption Maximum Wavelength, nm |
|---|---|---|
| 1 | PVB with Conventional Pigment | 638 |
| 2 | PVB with Hydroxy-Starved Pigment | 738 |
| 4 | MPVB-1 with Hydroxy-Starved Pigment | 850 |
| 5 | MPVB-1 with Conventional Pigment | 762 |
| 6A | MPVB-1 with Hydroxy-Starved Pigment and Cyclopentanol as milling solvent | 844 |
| 6B | MPVB-1 with Hydroxy-Starved Pigment, Cyclopentanol, and 2,3 butane diol | 740 |
| 6C | MPVB-1 with Hydroxy-Starved Pigment, Cyclopentanol, and 1,4 cyclohexane diol | 856 |
| 8 | PVB with Hydroxy-Starved Titanyl Phthalocyanine A-Form, Cyclopentanol as milling solvent | 758 |
| 9 | MPVB-1 with Hydroxy-Starved Titanyl Phthalocyanine A-Form, Cyclopentanol as milling solvent | 784 |
| 12 | MPVB-2 (with cyclohexanol unit) with Hydroxy-Starved Titanyl Phthalocyanine A-Form, Cyclopentanol as milling solvent | 794 |
| 13 | MPVB-2 (with cyclohexanol unit) with Hydroxy-Starved VOPc, Cyclopentanol as milling solvent | 820 |
| 14 | PVB with Hydroxy-Starved VOPc, Cyclopentanol as milling solvent (for comparison to Example 13) | 790 |

TABLE 2

Xerographic Data

| Example | Initial Voltage (V) −600 V | DDR(V/s) | Exposure Wavelength (nm) | Xerographic Speed (ergs/cm2) | Vr(V) |
|---|---|---|---|---|---|
| 1 | −615 V | 7.0 V/s | 660 nm | 80.0 | −150 V |
| 2 | −620 V | 3.0 V/s | 740 nm | 42.0 | −45 V |
| 4 | −620 V | 2.0 V/s | 850 nm | 5.0 | −10 V |
| 5 | −610 V | 2.5 V/s | 760 nm | 39.0 | −50 V |
| 6(A) | −620 V | 1.5 V/s | 850 nm | 3.5 | −5 V |
| 6(B) | −625 V | 2.0 V/s | 760 nm | 30.0 | −40 V |
| 6(C) | −550 V | 1.0 V/s | 850 nm | 2.0 | −0 V |
| 8 | −600 V | 3.0 V/s | 760 nm | 10.0 | −10 V |
| 9 | −660 V | 2.0 V/s | 780 nm | 3.5 | −3 V |
| 12 | −597 V | 0.4 V/s | 790 nm | 1.0 | −0 V |
| 13 | −530 V | 4.0 V/s | 820 nm | 8.0 | −10 V |
| 14 | | 6.0 V/s | 790 nm | 27.0 | −30 V |

Therefore, it is believed that the absorbance spectra (Table 1 and Figures) and the xerographic data (Table 2) indicate that forming a complex between metal oxide phthalocyanine pigment and modified PVB, according to this invention, tends to shift the absorption maximum to longer wavelengths and to improve the photoresponse at about the maximum absorption wavelength. Similar shifts of absorption to longer wavelengths and improvements of photoresponse is expected for embodiments of the invention that comprise either hydroxy-modified binders or amine-modified binders.

Using dehydrated, hydroxy-starved pigment in the complex with the specific binder also improves the absorption maximum and photoresponse. The complex formation and its particular photo-response appear to depend upon the chemical structure of the particular hydroxy binder or the particular amine binder, and on the particular hydroxy compound additives and the particular metal oxide phthalocyanine pigment used in the manufacture of the OPC.

Although this invention has been described above with reference to particular means, materials and embodiments, it is to be understood that the invention is not limited to these disclosed particulars, but extends instead to all equivalents within the scope of the following claims.

What is claimed is:

1. An electrophotographic photoconductive film layer comprising a complex between a metal oxide phthalocyanine and a binder comprising a monomer unit having an amine group, the monomer unit being selected from the group consisting of monomer units having the general formulas (7), (8), (9), (10), or (11):

$$—CH_2—C(R1)—CH_2NHR3 \quad (7),$$

$$—CH_2—C(R1)—O—R2—NHR3 \quad (8),$$

$$—CH_2—C(R1)—COO—R2—CH_2NHR3 \quad (9),$$

$$—CH_2—C(R1)—CONH—R2—CH_2NHR3 \quad (10),$$

$$—CH_2—C(R1)—CH_2O—CH_2—CH(CH_3)—NHR3—CH_2—O(CH_2)m— \quad (11),$$

wherein: R1=H, Me, or F; R2=alkylene, substituted alkylene, arylene, substituted arylene, cycloalkylene, or substituted cycloalkylene; R3 is H, Me, $C_6H_5$ or other alkyl, aryl, or cycloalkyl compounds); and m=0 to 30.

2. A film layer as set forth in claim 1, wherein the binder comprises a monomer unit comprising:

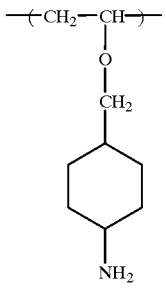

3. A film layer as set forth in claim 1, wherein the binder comprises a monomer unit comprising:

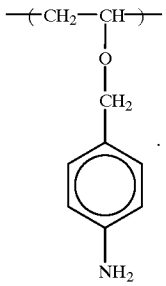

4. A film layer as set forth in claim 1, wherein the binder comprises a monomer unit comprising:

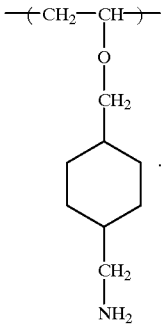

5. A film layer as set forth in claim 1, wherein —R1—R2 comprises a —$CH_2CH_2NH2$ unit.

6. A film layer as set forth in claim 1, wherein the binder comprises:

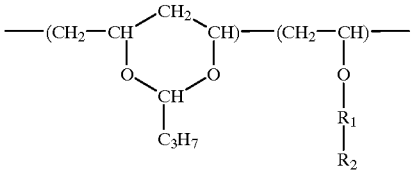

wherein R1=an alkylene, substituted alkylene, arylene, substituted arylene, cycloalkylene, or —C(O)R— group wherein R is an alkylene, cycloalkylene, or arylene group; and wherein R2=NHR3 wherein R3 is H, Me, $C_6H_5$ or other alkyl, aryl, or cycloalkyl groups.

7. A film layer as set forth in claim 6, wherein the said binder

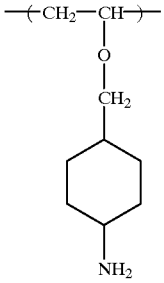

8. A film layer as set forth in claim 6, wherein the said binder comprises:

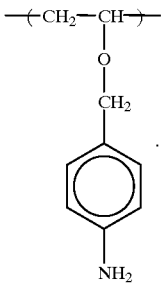

9. A film layer as set forth in claim 6, wherein the said binder comprises:

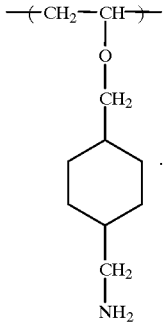

10. A film layer as set forth in claim 6, wherein —R1—R2 comprises a —$CH_2CH_2NH2$ unit.

11. A film layer as set forth in claim 6, wherein said metal oxide phthalocyanine comprises TiOPc.

12. A film layer as set forth in claim 6, wherein said metal oxide phthalocyanine comprises VOPc.

13. A film layer as set forth in claim 6, wherein said metal oxide phthalocyanine comprises dehydrated metal oxide phthalocyanine.

14. A method of making an electrophotographic photoconductive film layer comprising:

milling a metal oxide phthalocyanine compound together with a binder comprising a monomer unit having an amine group to produce a dispersion, and coating a substrate with the dispersion, wherein the binder comprises:

(1)

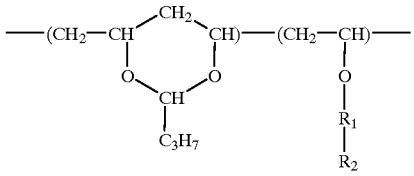

wherein R1=an alkylene, substituted alkylene, arylene, substituted arylene, cycloalkylene, or —C(O)R— group wherein R is an alkylene, cycloalkylene, or arylene group; and wherein R2=NHR3 wherein R3 is H, Me, $C_6H_5$ or other alkyl, aryl, or cycloalkyl groups.

15. A method as set forth in claim 14, wherein the milling step further comprises milling the metal oxide phthalocyanine and said binder together in the presence of a fatty alcohol.

16. A method as set forth in claim 14, further comprising dehydrating the said metal oxide phthalocyanine before milling.

17. A method as set forth in claim 14, wherein the said binder comprises:

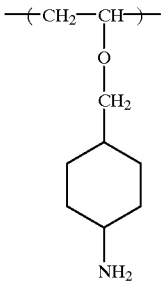
18. A method as set forth in claim 14, wherein the said binder comprises:
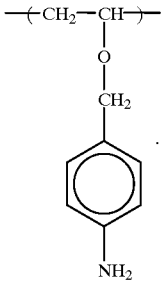
19. A method as set forth in claim 14, wherein the said binder comprises:
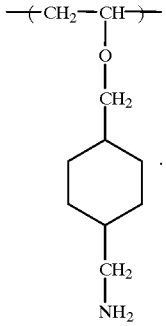
* * * * *